US005743403A

United States Patent [19]

Crysdale

[11] Patent Number: 5,743,403

[45] Date of Patent: Apr. 28, 1998

[54] INVERTED T TAB MEMBER HANGING STRIP

[75] Inventor: Donald T. Crysdale, 2800 E. Edgewood Dr., Shorewood, Wis. 53211

[73] Assignee: Donald T. Crysdale, Milwaukee, Wis.

[21] Appl. No.: 497,057

[22] Filed: Jun. 30, 1995

[51] Int. Cl.[6] ..... B65D 73/00; A47G 29/00

[52] U.S. Cl. ..... 206/482; 206/493; 206/806; 211/73; 211/113

[58] Field of Search ..... 211/72, 73, 113, 211/59.1; 206/482, 487, 806, 493, 479

[56] References Cited

U.S. PATENT DOCUMENTS

| | | | |
|---|---|---|---|
| 1,695,432 | 12/1928 | Lovejoy | 206/806 X |
| 2,793,762 | 5/1957 | Broussard | 211/113 |
| 2,971,874 | 2/1961 | Canno | 206/806 X |
| 4,476,983 | 10/1984 | Fast . | |
| 4,483,502 | 11/1984 | Fast . | |
| 4,485,575 | 12/1984 | Fast . | |
| 4,497,464 | 2/1985 | Fast . | |
| 4,546,943 | 10/1985 | Fast . | |
| 4,667,827 | 5/1987 | Calcerano | 211/72 X |
| 4,716,669 | 1/1988 | Fast . | |
| 4,718,627 | 1/1988 | Fast et al. . | |
| 4,911,392 | 3/1990 | Fast . | |
| 5,103,970 | 4/1992 | Nielson et al. . | |
| 5,123,189 | 6/1992 | Fast et al. . | |
| 5,148,927 | 9/1992 | Gobia . | |
| 5,199,578 | 4/1993 | Pendergraph et al. | 211/72 |
| 5,235,766 | 8/1993 | Fast et al. . | |
| 5,248,036 | 9/1993 | Radocha, Sr. et al. . | |
| 5,261,175 | 11/1993 | Gebka . | |
| 5,386,916 | 2/1995 | Vahulis | 211/113 |

OTHER PUBLICATIONS

Fast Industries, Inc. "Sell Strip® Strip Merchandisers" catalog and price list.

*Primary Examiner*—Bryon P. Gehman

[57] ABSTRACT

A point-of-purchase clear hanging strip having T-shaped cutout portions for holding, displaying and dispensing a plurality of generally like items. The hanging strip includes an elongated panel made of a transparent, flexible, non-stretchable material. The elongated panel is folded upon itself to form a channel for receiving a stability member therein. An inverted "T" tab member engages the article and includes a straight shaft integral with the elongated panel and an enlarged generally elliptical head portion integral with the base portion for maintaining the article on the tab member.

7 Claims, 2 Drawing Sheets

INVERTED T TAB MEMBER HANGING STRIP

BACKGROUND AND SUMMARY OF THE PRESENT INVENTION

This invention relates generally to display units, and specifically to a point-of-purchase hanging strip for holding, displaying and dispensing a plurality of generally like articles.

Point-of-purchase hanging strips are well known in the art. Many are adapted to be suspended from a hook at the end of an aisle or near a check-out counter or in any variety of retail outlets. The display unit may include a header panel with a mounting hole in the header panel for receiving a hook from which the unit is suspended.

Prior display units are usually provided with a plurality of hooks or the like for separately and serially suspending individual blister packs. However, blister packs which are prehung on the display units before shipping tend to fall off when being packaged or being transported. Consequently, the retail outlets which receive the transported display units must rehang individual blister packs, which fell off during transport, on the individual hooks from which they fell off. This process is expensive due to the labor required to rehang the individual blister packs.

In addition to the blister packs falling off the hooks of prior hanging strips during packaging and shipping, the larger weight of some types of blister packs may tend to deform the hooks, causing the hooks to fail. In order to address this problem, manufacturers of prior hanging strips have attempted to make hanging strips out of plastics having a thickness of 20 mil and larger. However, plastic of this thickness does not flex easily. As such, the inflexibility of prior art point-of-purchase hanging strips results in wasted space when packaging the display units with the blister packs pre-attached. This, in turn, increases the cost to transport the product.

One attempt to combat this problem is disclosed in the Nelson et al U.S. Pat. No. 5,103,970, entitled "Collapsible Display System". The '970 patent discloses a collapsible display system wherein the plastic display system includes a plurality of score lines between each individual hook so as to allow the display unit to fold. However, this system is inadequate in that the scored plastic tends to break and fall apart rendering the display unit worthless.

Therefore, it is a primary object and feature of the present invention to provide a unique point-of-purchase clear hanging strip having T-shaped cutout portions for holding, displaying and dispensing a plurality of generally like items.

It is another object and feature of the present invention to provide a point-of-purchase hanging strip permitting a plurality of generally like items to be suspended and visible utilizing a folded channel for receiving a stability member and first of a multiplicity of inverted tabs.

It is a still further object and feature of the present invention to provide a point-of-purchase hanging strip for displaying a plurality of like articles while minimizing the packaging requirements for each article.

It is a still further object and feature of the present invention to provide a point-of-purchase hanging strip which is of sufficient strength to hold the like articles, and yet of sufficient flexibility to allow the hanging strip to be undulated during packaging, shipment, and handling.

A point-of-purchase hanging strip is provided for holding, displaying and dispensing at least one merchandise item. The point-of-purchase hanging strip includes an elongated panel made of a transparent, flexible, non-stretchable material and includes opposite sides and first and second ends.

The elongated panel may be folded upon itself at a predetermined fold line so as to form a channel defined by the fold line and the first end of the elongated panel. A stability member may be received in the channel for stabilizing the opposite sides of the elongated panel.

An inverted "T" tab member is provided for engaging the article. The tab member includes a base portion having a first end integral with the second panel and a second end depending therefrom. The tab member further includes a generally elliptical head portion integral with the second end of the base portion. The head portion is of sufficient flexibility so as to allow the elliptical head portion to be manipulated through an opening in the article and thereafter, return to its original shape thereby maintaining the article on the point of purchase hanging strip.

A mounting hole may be placed through the elongated panel and the stability member at a point between the fold line and the first end of the elongated panel, and at a point equally distant from opposite sides of the elongated panel. A hook may be extended through the mounting hole in order to suspend the hanging strip.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DESCRIPTION OF THE PREFERRED EMBODIMENT

Figure 1:
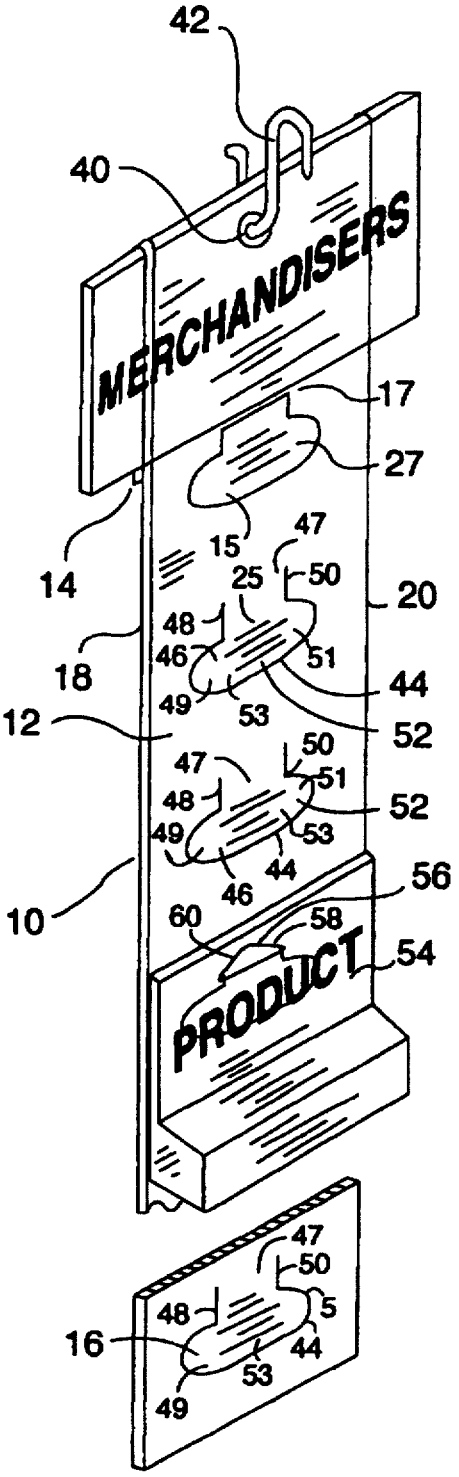
FIG. 1 is a isometric view of the point-of-purchase hanging strip of the present invention.

Referring to FIGS. 1–5, a point-of-purchase hanging strip in accordance with the present invention is generally designated by the reference numeral 10. The point-of-purchase hanging strip 10 includes a generally elongated panel 12 having first 14 and second 16 ends and opposite sides 18 and 20. The elongated panel 12 is preferably made of a flexible, stretchable material such as 8–12 mil vinyl, PETG or the like, signified by the reference character T in FIG. 6, and is transparent.

The first end 14 of the elongated panel 10 includes an inverted "T" tab member 22 having a base portion 24 formed integral with the first end 14 of elongated panel 10. The base portion includes a pair of opposing sides 15, 17 which extend parallel to the opposite sides 18 and 20 of elongated panel 12.

Figure 2:
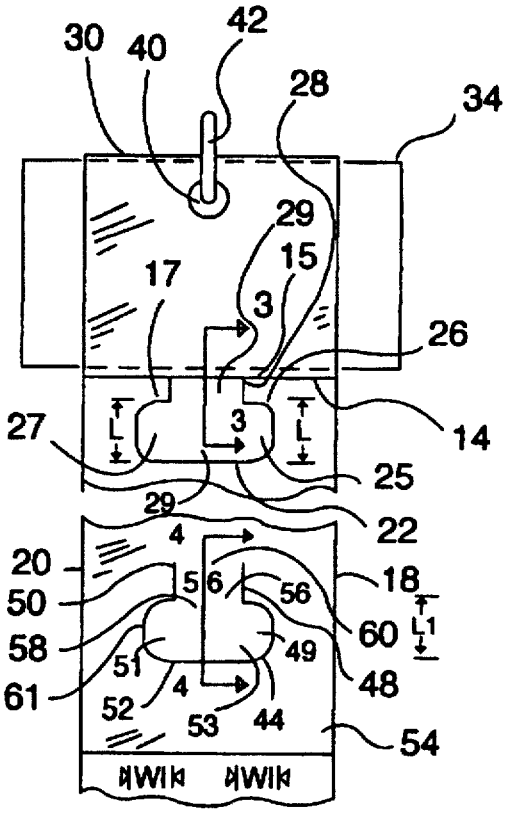
FIG. 2 is a rear elevational view of a portion of the point-of-purchase hanging strip of FIG. 1.

Referring to FIG. 2, base portion 24 further includes a a straight shaft whereby the head defines a pair of hemispherical limbs 25, 27 extending from opposite sides 15, 17, respectively. Each hemispherical limb 25, 27 has a length L greater than its width W. As described, hemispherical limbs 25 and 27, in combination with portion 29 of base portion 24, form an enlarged elliptical head portion 26.

Tab member 22 is receivable in a slot 28 in the elongated panel 12. Slot 28 has a width greater than the width between sides 15, 17 of tab 22, but smaller than the width of the elliptical head portion 26 of tab member 22, such that when elongated panel 12 is folded upon itself at a predetermined fold line 30, head portion 26 of tab member 22 may be folded and manipulated through slot 28. Upon return to its original shape, head portion 26 of tab member 22 prevents tab member 22 from sliding out of slot 28, and thereby preventing elongated panel 12 from unfolding.

With the elongated panel 12 folded upon itself, fold line 30 and end 14 of elongated panel 12 form a pair of substantially parallel, spaced apart lines for defining a rectangular channel 32, FIGS. 3, 6, and 7–8, therebetween. Rectangular channel 32 is specifically adapted for receiving a strengthening member such as a header panel 34. Header panel 34 is constructed of a semi-rigid, non-stretchable material.

Figure 3:
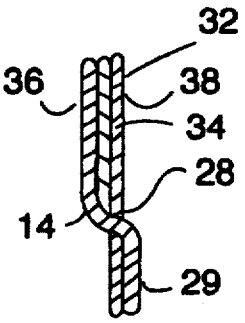
FIG. 3 is a cross-sectional view of the point-of-purchase hanging strip of FIG. 2 taken along line 3—3.
Figure 4:
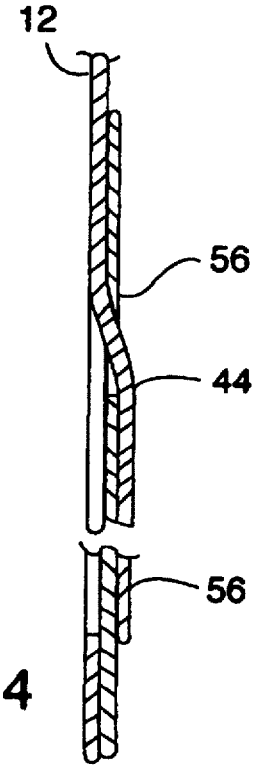
FIG. 4 is a cross-sectional view of the point-of-purchase hanging strip of FIG. 2 taken along line 4—4.
Figures 5, 6, 7, 8, 9:
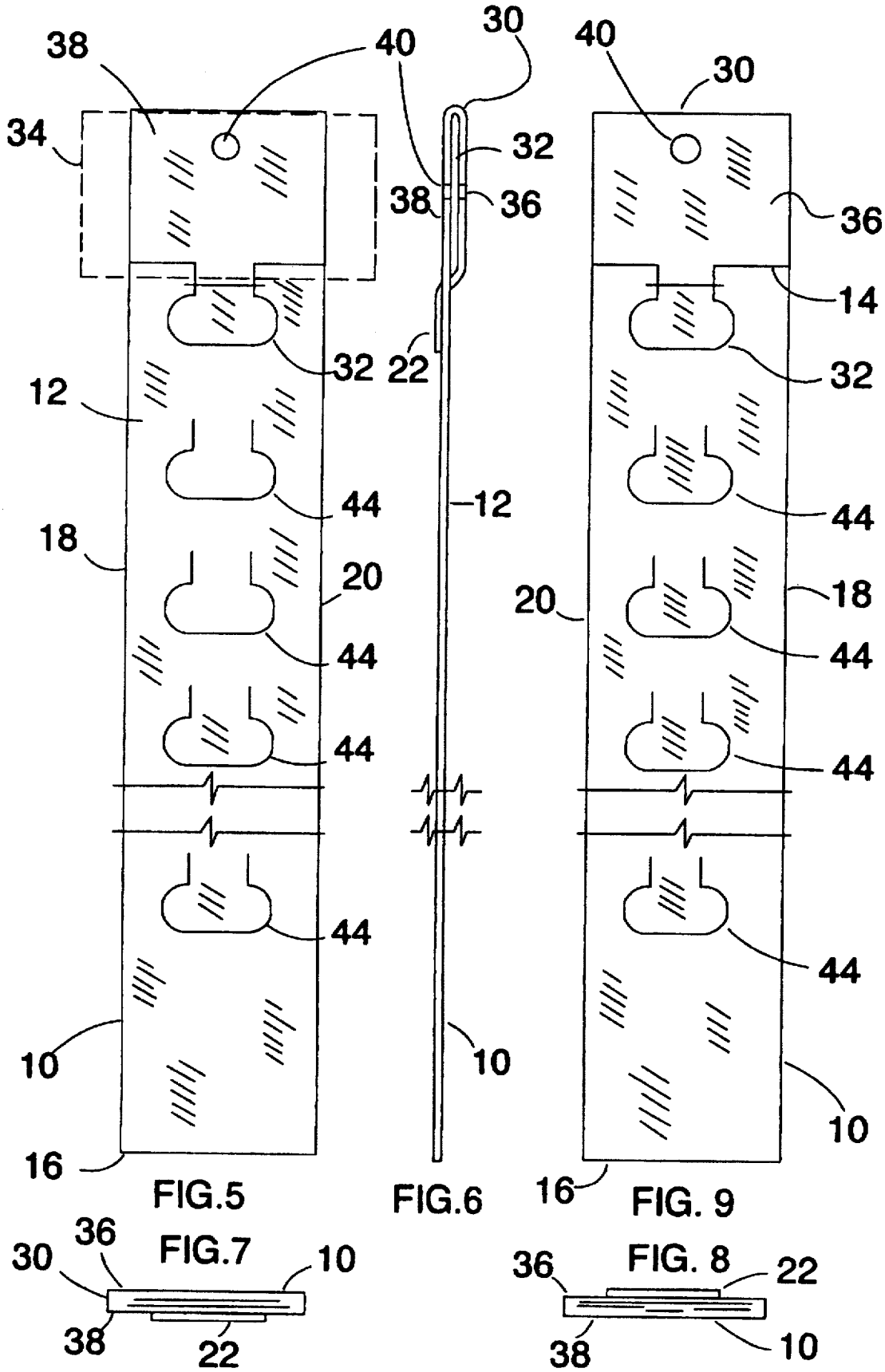
FIG. 5 is a front elevational view of the point-of-purchase hanging strip of the present invention.
FIG. 6 is a side elevational view of the point-of-purchase hanging strip of FIG. 5.
FIG. 7 is a top elevational view of the point-of-purchase hanging strip of FIG. 5.
FIG. 8 is a bottom elevational view of the point-of-purchase hanging strip of FIG. 5.
FIG. 9 is a rear elevational view of the point-of-purchase hanging strip of FIG. 5.

As best seen in FIG. 3, header panel 34 is received between first 36 and second 38 portions of elongated panel 12 and may include identifying indicia or other point of sale advertising. The strengthening member or header panel 34 increases the stability of elongated panel 12 and prevents the curling of opposing sides 18 and 20 of elongated panel 12.

A mounting hole 40, FIGS. 1–2 and 5–6, aligned through portions 36 and 38 of elongated panel 12 and header panel 34 may be provided. In the preferred embodiment, the mounting hole 40 is located equally distant from opposite sides 18 and 20 of elongated panel 12 and is adapted for receiving a hook 42, FIGS. 1–2, from which the display unit 10 may be suspended.

Referring to FIGS. 1–2, elongated panel 12 further includes a plurality of separately and serially spaced second tab members 44, substantially identical in construction to first tab member 22. Each second tab member 44 is die cut from elongated panel 12 and includes a cut-out portion 46 having a base 47 integral with elongated panel 12. The cut-out portion 46 includes a pair of opposing sides 48 and 50 which extend parallel to the opposite sides 18 and 20 of elongated panel 12.

Referring to FIG. 2, cut-out portion 46 further includes a pair of hemispherical limbs 49 and 51 extending from opposite sides 48 and 50, respectively. Each hemispherical limb 49, 51 has a length L1 greater than its width W1. As described, hemispherical limbs 49 and 51, in combination with portion 53 of cut-out portion 46, form an enlarged elliptical head portion 52.

In operation, second tab member 44 is adapted for receiving and holding a blister pack 54 or the like thereon for display. A blister pack 54 wraps around a product for packaging the product therein. The blister pack includes a slot or opening 56 therethrough. Opening 56 is partially defined by a pair of diverging sidewalls 58 and 60 formed in blister pack 54.

Due to the flexibility of the material, enlarged elliptical head portion 52 of second tab member 44 may be manipulated through opening 56 in blister pack 54. After inserting head portion 52 through opening 56, head portion 52 of tab member 44 returns to its original shape. As a result, sides 58 and 60 of opening 56 bear against the outer edge 61 of enlarged elliptical head portion 52 and prevent the blister pack from falling out of second tab member 44. In order to remove blister pack 54 of tab member 44, enlarged elliptical head portion 52 of second tab member 44 must be manipulated and folded so as to fit through opening 56 and blister pack 54.

The flexibility of elongated panel 12 allows the blister packs to be attached to the elongated panel 12 and thereafter folded into cartons in the minimal amount of space required for shipping. In addition, the enlarged elliptical head portion 52 of second tab member 44 adds a significant amount of strength to the flexible material from which the second tab member 44 is constructed. This allows the point-of-purchase hanging strip 10 to hold larger and heavier blister packs 54 than previously possible.

Various modes of carrying out the invention are contemplated as being within the scope of the following claims particularly pointing out and distinctly claiming the subject matter which is regarded as the invention.

I claim:

1. A point-of-purchase hanging strip for holding, displaying and dispensing at least one product, said hanging strip comprising:

(a) an integrally formed elongated transparent and flexible plastic suspension panel including a top first end and a bottom second end, said panel first end including a T-shaped first tab member extending from the free edge of said first end, said first tab member including a pair of hemispherical limbs that in part define an elliptical head portion of said tab member and a base portion extending from lower ends of said limbs, said first end further including a slot, a portion of said suspension panel at said first end being folded over to form a channel and said first tab member being inserted through said slot to both maintain said channel and define an engaging means in the shape of an inverted T to engage an opening in a product;

(b) a stability member received within said channel for stabilizing opposite sides of said suspension panel, wherein said stability member provides indicia relating to the at least one product; and (c) said suspension panel further having vertically spaced integral means for supporting at least one product, said integral means comprising a plurality of spaced die-cut portions defining second tab members, said second tab members each being generally shaped as an inverted T and also including a pair of hemispherical limbs that in part define an elliptical head portion of each said second tab member and a base portion extending from upper ends of said limbs, said base portion being hinged to said suspension panel, at least one of said tab members extending outwardly of said suspension panel to engage an opening in a product.

2. The hanging strip of claim 1, wherein said suspension panel is generally rectangular.

3. The hanging strip of claim 2, wherein the stability member comprises a generally rectangular header panel.

4. The hanging strip of claim 3, further including a mounting hole extending through said suspension panel and said header panel between the fold of said suspension panel and said first end of said suspension panel.

5. The hanging strip of claim 4, further comprising a hook extending through said mounting hole such that said strip may be suspended by said hook.

6. The hanging strip of claim 5, wherein said mounting hole is located equi-distant from opposite sides of said suspension panel.

7. The hanging strip of claim 1, wherein said stability member is made of a semi-rigid, non-stretchable material.

* * * * *